US010941609B2

(12) United States Patent
Noy

(10) Patent No.: US 10,941,609 B2
(45) Date of Patent: Mar. 9, 2021

(54) SYSTEM FOR AUTOMATING A SLIDING PANEL LOUVER AND METHOD OF RETROFITTING THE SAME

(71) Applicant: Amir Noy, Hertzlia (IL)

(72) Inventor: Amir Noy, Hertzlia (IL)

( * ) Notice: Subject to any disclaimer, the term of this patent is extended or adjusted under 35 U.S.C. 154(b) by 292 days.

(21) Appl. No.: 15/781,132

(22) PCT Filed: Dec. 2, 2016

(86) PCT No.: PCT/IL2016/051293
§ 371 (c)(1),
(2) Date: Jun. 3, 2018

(87) PCT Pub. No.: WO2017/094017
PCT Pub. Date: Jun. 8, 2017

(65) Prior Publication Data

US 2018/0355660 A1 Dec. 13, 2018

(30) Foreign Application Priority Data

Dec. 3, 2015 (IL) ..... 242923

(51) Int. Cl.

| | |
|---|---|
| ***E06B 7/09*** | (2006.01) |
| ***E05D 15/06*** | (2006.01) |
| ***E05F 15/641*** | (2015.01) |
| ***E05F 15/635*** | (2015.01) |

(52) U.S. Cl.
CPC ..... *E06B 7/09* (2013.01); *E05D 15/063* (2013.01); *E05D 15/0665* (2013.01); *E05F 15/641* (2015.01); *E05F 15/635* (2015.01); *E05Y 2201/43* (2013.01); *E05Y 2201/64* (2013.01); *E05Y 2201/716* (2013.01); *E05Y 2600/456* (2013.01); *E05Y 2900/146* (2013.01); *E05Y 2900/148* (2013.01)

(58) Field of Classification Search
CPC ..... E06B 7/09; E05D 15/0665; E05D 15/063; E05F 15/641; E05F 15/635; E05Y 2600/456; E05Y 2201/64; E05Y 2201/716; E05Y 2201/43; E05Y 2900/148; E05Y 2900/146
USPC ..... 49/31, 73.1, 74.1, 77.1, 80.1, 118
See application file for complete search history.

(56) References Cited

U.S. PATENT DOCUMENTS

2017/0058596 A1* 3/2017 Teuscher ..... E06B 9/364

* cited by examiner

*Primary Examiner* — Justin V Lewis
(74) *Attorney, Agent, or Firm* — The Law Office of Joseph L. Felber

(57) ABSTRACT

A system for controlling a louver blind mobile panel that is moveable along a rail installed in a living space construct. The mobile panel featuring an inner volume capable of housing at least one motor that is functionally coupled to an electronics unit. The electronics unit is controlled with a wireless remove controller to control the activity of the at least one motor.

20 Claims, 9 Drawing Sheets

SYSTEM FOR AUTOMATING A SLIDING PANEL LOUVER AND METHOD OF RETROFITTING THE SAME

FIELD OF THE INVENTION

The present invention generally relates to louvered window and in particular to a system for automating the movement of a louver window shutters installed on a sliding panel and retrofitting the same on existing non-automatic window shutters.

BACKGROUND OF THE INVENTION

Shutter and/or blind systems are commonly used to control both shading and airflow in living space openings such as in apartments and/or homes. Shutter systems are used in various locations and are commonly found in windows, doorways that generally vary in size based on the size of the opening. Shutter systems are used to control a tradeoff between shading and airflow within the living space. In hot climates the shutter system is preferably external to a glass system that closes the same opening, since internal mounting cause's heat to accumulate inside the room.

Certain types of shutters and/or blinds are fit with a lever to provide a single control point capable of controlling a group of shutters and/or blinds, such that a group of shutters can be simultaneously controlled to assume a certain shading angle, usually in the form of a manual lever. Such shutter and/or blind system that is fit with at least one lever for controlling a group of shutters and/or blinds is commonly known as a louver and/or a louvered shutter.

State of the art louvered shutter systems are mounted on rectangular frames are very common and very practical, and are commonplace in many Mediterranean states as the louver shutter systems is well suited for Mediterranean weather conditions that features high solar radiation.

The louvered shutters are used in a wide range of sizes, ranging from a single frame for a small window, for example having dimensions of about 60 cm by 80 cm, to multiple interfacing frames to cover a large living space opening, for example having dimensions of about 600 cm by 260 cm. In such louver systems at least one or more panels are configured to move sideways in order to fully open the living space opening, it may be fully closed with blinds engaging to completely block the opening, or the frames may be placed in a position to block the opening while controlling the level of shading and/or penetrating sunlight by manually controlling the angular position of at least a group of the louvers at the various levered control points.

Control of the group of louvers is provided by way of tilting the lever to assume an angle of up to 180 degrees to interchangeably control the level of shading and airflow within the living space.

A single frame of louvered blinds, for typical small window, slides sideways on a bottom and/or top rail into a wall pocket construct disposed between the internal and external walls or outside the external wall. Larger windows have multiple frames that slide on rails either to a pocket construct, as described above, or stacking one in front of the other to maximize the non-blocked open portion. Large frames typically include a number of, generally two to six, groups of louvered blinds, where each group is configured to be independently controlled with its own lever and/or swivel handle, to allow tilting of each group of blinds separately.

The set of louvered shutters are most commonly fit along the external walls of the living space for example defining a window, patio and/or porch. However, louvered shutters may be fit over any open living room space.

While the functionality of state of the art louvered shutters and/or blinds in sliding frames, are excellent in terms of shading and airflow control within a living space, however state of the art louvered shutters systems of the above described type are operated manually. Operating is done by changing the blinds groups tilt angle manually with small levers and sliding the carrying panel sideways.

There are many commercially available automatic systems to control the shading and/or degree of light penetrating within a living space while controlling the airflow in the same living space. However, such automated systems are most commonly controlled with motors that function to move the shutters by way of collectively rolling them up and down. In other automated systems shutters and/or blinds are tilted by motor(s) however such systems are suited for shutter types that are rolled up/down within a static and/or fixed framework such as a wall. Such rolled shutter systems utilize a fixed external motor system disposed within a confined space, niche or the like housing, for example a dedicated niche within a wall. Typically the motor is placed in a dedicated niche within the wall on top of the window and/or opening therein only allowing a vertical movement of up and down, while not allowing use of the shutters in the lateral and/or sideway direction. Furthermore, such shutters are limited in the degree to which they may be opened or closed. Similarly such systems are further limited in that the motors do not provide full control of the opening in the vertical direction (up/down) where for example, only a portion of the blinds may be controlled from bottom to top, that is a partial opening where the top portion of the blinds are open while the bottom portion is closed is not possible with such motorized roll-up shutter systems. In other commercially available automated systems the control of is limited to tilting the louvers without any option for moving the frame as it is fixed.

SUMMARY OF THE INVENTION

The present invention overcomes the deficiencies of the background by providing a system and method for automating a framed living space area opening and/or partition that are used to house louvered blinds systems, shutters and the like systems for controllably opening the air space opening to allow air to flow therethrough, most notably for shutters systems that are external to (behind) the glass windows.

In embodiments, the present invention may be used to provide remotely controlled lateral movements of at least one or more framed objects, for example including but not limited to a sliding panel, a sliding panel comprising a louver blinds, glass window, sliding doors or the like.

In embodiments, the present invention may be utilized to remotely and controllably provide lateral movement of framed objects provided within a framed living space area opening, wherein a framed living space area opening may for example include but is not limited to windows, patios doorway, back yard doorway, sliding doors, solariums doors, the like or any combination thereof.

Embodiments of the present invention provide a system for automating the use of a framed construct used within the framed living space area opening, for example including but not limited to framed louver blinds, blinds, windows, sliding doors the like or any combination thereof.

Embodiments of the present invention provide for readily retrofitting such framed living space openings without requiring constructional changes to the existing framed living space area framework, for example walls, doorways, crossbar, frame head or the like constructs. In embodiment, such retrofit is especially suitable for mounting the device, and/or system constituents, and/or parts within commercially available structural components of individually sliding panels and/or frames that are used for manual operation, for example including but not limited to aluminum profiles, that are by far the most common, or the like frames as is known in the art.

Embodiments of the present invention provide an automation system that is preferably embedded within the framework of the panel and/or framed construct that is automated. The embedded automation system preferably includes: at least one controller, at least one or more motor units, at least one or more power source and at least one remote communication module, all deployed within an internal volume of the movable framed construct and/or panel. For example, an automated louver frame system may be fit within a framed living space framework without requiring constructional changes.

In embodiments the present invention provides for achieving all the automation functionality with minimal alterations to an existing manual shutters or blind system, for example as described in the background section above, wherein the alteration required is limited to the shutter system's framework, so as to allow mounting the system parts within an open inner volume of pane and/or frame. The small changes to the system by mounting the system within the framework provide for maintaining the maximal dimensions of the louvered section within the living space opening therein maximizing airflow while maintaining a low profile of the overall system. Preferably retrofitting the panel and/or frame with the system of the present invention does not increase the thickness of the frame and/or panel therein maintaining its ability to overlap with adjacent frames.

The current invention allows for the automation of framed constructs, for example in the form of a louver blind system disposed over a window or a patio doorway. Automation of the louvered blinds provides a user with the ability for example to control the louvered blind position and/or angle within a framed louver. Similarly, the position of the framed construct, for example forming a sliding doorway, within the framed living space framework.

The current invention provides for retrofitting the automation system within an existing framed living space opening framework by replacing the units employed within the framed living space opening framework. Such retrofitting does not require constructional changes to the framework for example including but not limited to physical constructional changes to walls, ceilings and/or electrical wiring in and around the framed living space opening.

In embodiments, the inventions allows for use of low power motors and relative low battery capacity due to its use in sliding type of frames and rotation of louvers. Such movements merely overcome friction forces. This is in contrast to all up/down rolling type of shutters or blinds that need to elevate the entire shutters of the frame that may be of significant weight of up to hundreds of kilograms.

In embodiments, the utilization of remotely controlled motors does not limit a user for manually manipulating and/or controlling the movement of a frame or louver within a framework. Accordingly embodiments of a system according to the present invention, allows a user to manually manipulate a louver and/or a sliding panel/frame while simultaneously providing for manual control of the movement of the frame/panel and louver. This is a needed failsafe precaution. Such failsafe precautions are not available in most existing automated systems, such as the up/down rolling blind type that cannot be operated and remain stuck in case of power or other system failure.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

The principles and operation of the present invention may be better understood with reference to the drawings and the accompanying description. The following figure references labels are used throughout the description to refer to similarly functioning components are used throughout the specification hereinbelow.

Figure 1:
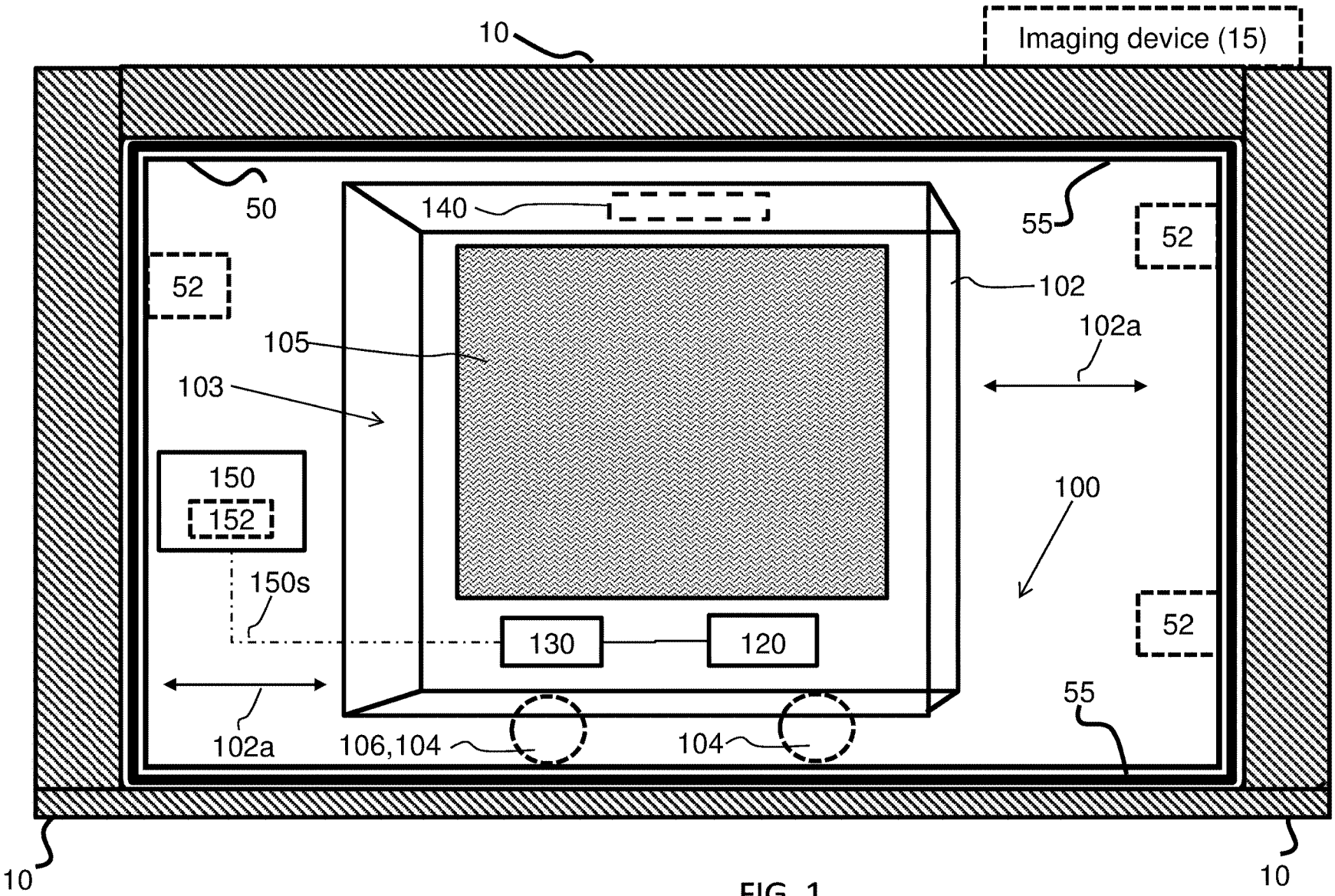
FIG. 1 is a schematic block diagram of an exemplary system according to the present invention.

10 living space building construct (ceiling, floor and walls) in which there is an opening;
15 electronics and/or video camera installed in living space;
50 external fixed frame;
52 marker on fixed frame;
55 fixed frame rail;
100 system;
102 mobile panel;
102*a* panel lateral mobility;

103 internal volume of mobile panel frame;
104 motorized wheel;
105 panel functional segment
106 balancing passive wheel;
110 louver blind;
112 blinds/shutters;
115 louver lever;
120 motor assembly;
120*w* wheel motor assembly;
120*r* louver motor assembly;
120*s* motor control signal;
121 motor mechanical components;
122 motor controller module;
124 motor driver module;
130 electronics unit;
132 controller module;
134 power module;
135 display;
136 wireless communication module;
138 sensor module;
140 photovoltaic cells;
150 remote controller;
152 video camera;

FIG. 1 shows a schematic block diagram of system 100 according to embodiments of the present invention of a system for automating the lateral movement, shown with arrows 102*a*, of at least one or more mobile panel constructs 102 that optionally and preferably features a panel functional segment 105 within a fixed framed construct 50 and rail 55 that are affixed to an open space construct 10 for example in the form of a wall, floor, ceiling, or the like.

Panel functional segment 105 may be provided in optional forms for example including but not limited to a framed louver blinds 110, window, dry keep window, rollup blinds, motorized rollup blinds, the like or a combination thereof. Mobile panel 102 may be fit with at least one or more functional segments 105. Optionally a single mobile panel 102 may be fit with the same or different forms of functional segments 105.

Embodiments of the system 100 provide for automating the movement of at least one or more mobile panel 102 along rail 55 while simultaneously providing for control the status of functional segments 105 disposed along a surface of the panel 102. System 100 comprises at least one or more mobile panel 102, featuring at least one or more functional segment 105, a remote controller 150, wherein an internal volume 103 of mobile panel 102 is fit with at least one or more motor units 120, electronics unit 130 that is configured to be in wireless communication with remote controller 150. Remote controller 150 provides for control signal 150*s* to communicate and control electronics unit 130 that in turn provide a motor control signal 120*s* to operate and control at least one or more motors 120, and wherein at least one or more motors 120 provide for controlling movement of panel 102 and/or operation of functional segment 105.

Framed construct 50 forms a fixed frame and/or an external frame that is directly and securely coupled with floor, wall, internal wall segment, external wall segment, and/or ceiling 10 of a living space opening. Fixed frame 50 and rail 55 are configured to form a base to receive a mobile panel constructs 102 that may be realized in the form for example including but not limited to a window, a dry keep window, sliding doors, shutter system, blinds system, blinds, framed louver blinds, shutters, manual rollup blinds, motorized rollup shutters, or the like constructs that is provided to control the open and/or closed status of the living space area.

Frame 50 may comprise at least one or more rail 55 along at least one or more surface thereof.

Rail 55 may be affixed and/or mounted on a frame 50 or directly along a construct 10, along any face or surface thereof, for example including but not limited to: an inner surface or an external surface, or along an inner portion between the external and inner surfaces.

Rail 55 generally provides a channel and/or framework for defining and facilitating the lateral movement 102*a* of a mobile panel construct 102 such that panel 102 may be moved latterly 102*a*, along rail 55.

Figure 3A:
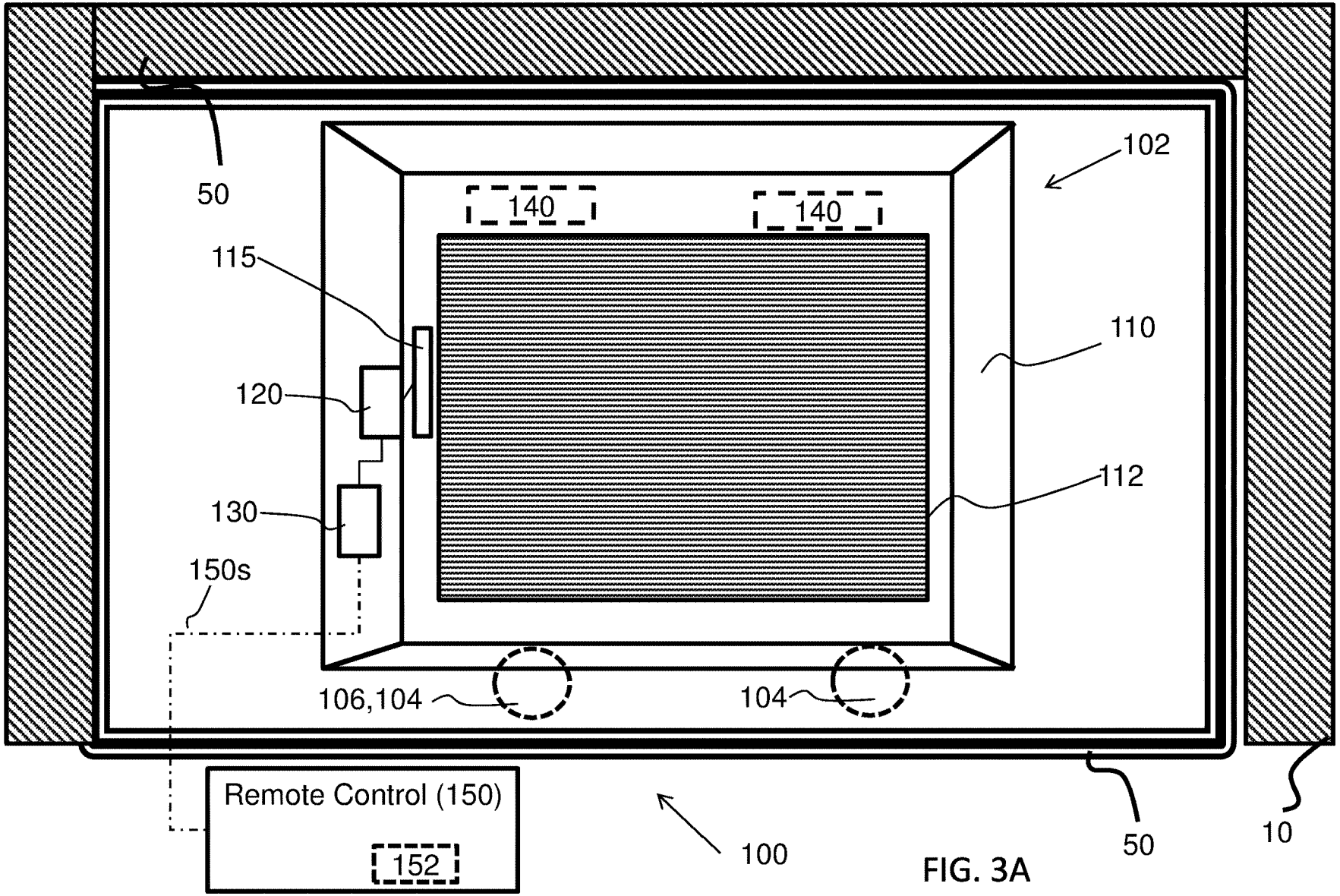
FIG. 3A-B are schematic illustrative diagrams of embodiments of an exemplary system according the present invention.
Figure 3B:
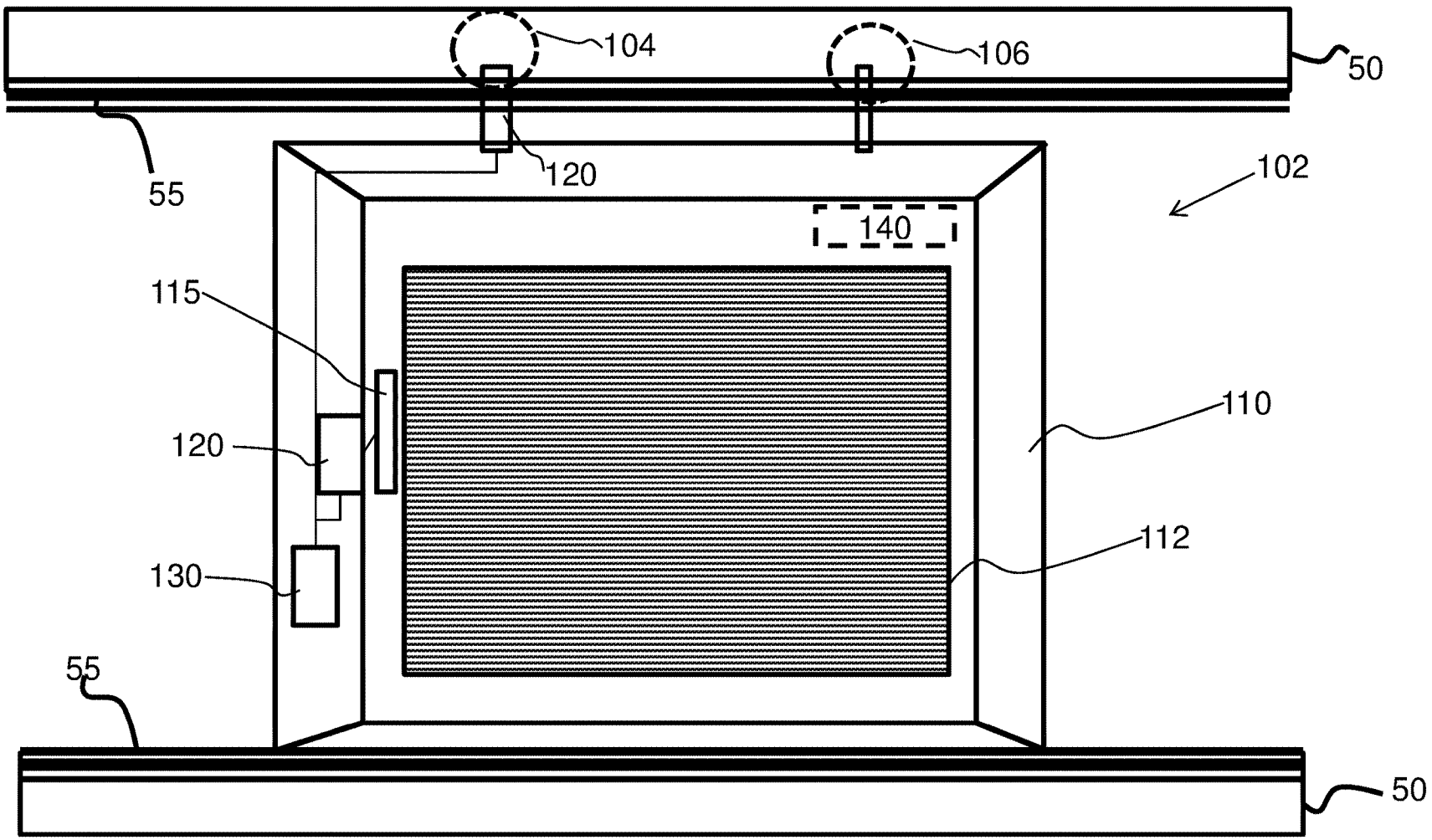

Rail 55 may be fixed to the bottom of the opening, where the mobile panel 102 slide on it (as shown in drawings for simplicity), or it can be fixed to the top of the opening where the mobile panel 102 hangs on its wheels 104, 106 that run on the rail (for example as shown in FIG. 3B).

Embodiments of the present invention provide a system 100 for automating a mobile panel construct 102 that is readily retrofit within an existing living space fixed frame construct 50. System 100 is characterized in that it alleviates the need to undertake expensive, messy constructional changes to the walls, floor and ceilings 10 of housing frame 50. Most preferably the construction 10 is not altered for the purpose of fitting system 100. In a preferred embodiment the retrofitting process of system 100 is further advantageous as the retrofitting process does not require the instillation of running power supply wirings or lines to accommodate system 100 within construct 10.

The need for a system that may be retrofit onto an existing fixed frame construct 50 is particularly realized where the living space constructional walls, floors and ceilings 10 are provided from concrete where making changes to the concrete framework 10 is expensive, messy and labor intensive. Furthermore such constructional changes in some instances lead to esthetically unpleasing a result.

System 100 according to the present invention provides a way for automating and facilitating lateral movement and/or sliding of at least one or more mobile panel construct 102 within an existing fixed frame construct 50 and rail 55, characterized in that mobile panel 102 may be controllably moved within fixed frame 50 along rail 55 with a remote controller 150 utilizing wireless communication protocols. System 100 further provides for controlling functional segments 105 with remote controller 150 by way of wireless communication.

System 100 may further comprise and therein utilize existing electronics devices and/or sensors 15 already present in the living space 10, for example as part of a smart home application, surveillance and/or an alarm system. Preferably electronic devices 15 provide for further facilitating control of the position and location of the frame and/or blinds by associating the existing electronic devices and/or sensors with remote controller 150. For example, remote controller 150 may be configured to be in communication with the existing electronic devices and/or sensor 15, for example a video camera forming a part of a surveillance system. Electronic device 15 may be in functional wireless communication with remote controller 150, for example utilizing wireless communication protocols as is known in the art. For example, an existing electronic device 15 in the form of a video camera installed within living space 10 may be configured to be in wireless communication with remote controller 150. Therein video camera 15 provides remote controller 150 with video data of living space 10, which may be utilized to analyze and control the position of any member of system 100 so as to provide control the position of at least one or more of panel 102, or blinds 112, therein controlling its status for example open, closed, partially open, partially closed, or the like.

Preferably remote controller 150 in communication with existing devices 15 in the form of a video camera may utilize image process and/or video processing protocols as is known in that art so as to provide control of any part of system 100.

Optionally remote controller 150 may be provided with a camera 152 to provide similar control any portion comprising system 100.

Remote controller 150 provides for controlling the position at least one or more portions comprising system 100, for example including but not limited panel 102, and blinds 112 or the like, preferably remote controller 150 and each controlling unit 130 of each panel 102 comprises an addressing logic, set during installation, that allows for a single remote control device 150 to control in a synchronized manner a plurality of panels 102 that share same opening, and of plurality of openings in same room or coverage area.

In embodiments remote controller 150 may further provide for diagnostics and feedback control of the constituents of system 100, for example including but not limited to wheels 104 and/or motors 120. Preferably such monitoring and feedback control may detect instantaneous status and/or any failures or problems associated therewith. For example, controller 150 may be used to detect buildup of over-current that indicates end of movement which may be communicated to it via communication module 136.

In embodiments of system 100, fixed frame 50 and/or rail 55 may be fit with at least one or more indicators and/or markers 52 that may facilitate the functions of a sensor module 138. Markers 52 may for example include but are not limited to at least one or more selected from: reflectors, color marks, stickers of certain optical or magnetic characteristics, the like or any combination thereof.

Mobile panel 102 comprising a lower edge, an upper edge, a right edge and a left edge, wherein at least one of the upper edge or lower edge may be configured to move along at least one or more rail 55 according to instructions from remote controller 150.

Mobile panel construct 102 comprises an internal frame volume 103 that is configured to house at least one or more motors 120, electronics unit 130, characterized in that electronics unit 130 and at least one motor 120 may be controlled remotely with a remote controller 150 providing a remote control signal 150*s* utilizing wireless communication protocols.

Figure 6:
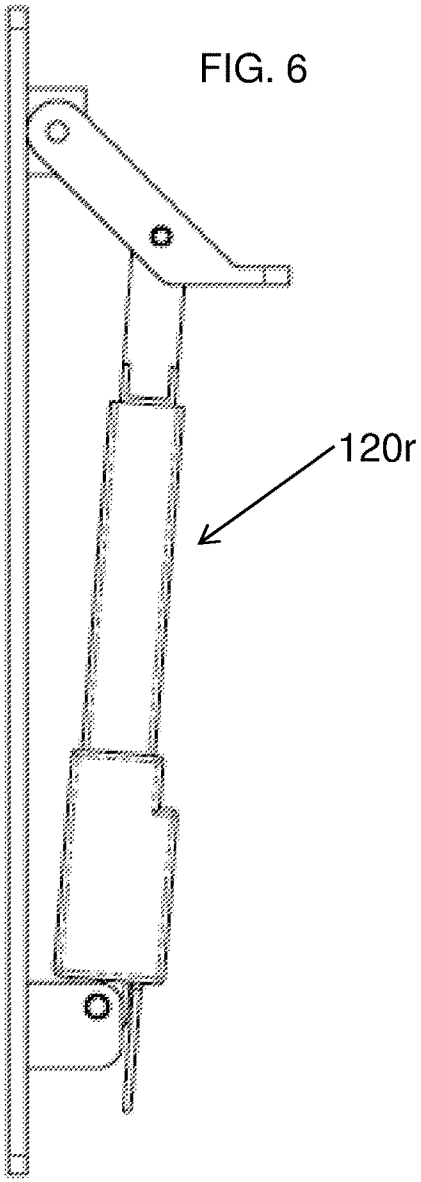
FIG. 6 is a schematic illustrative diagram of an embodiment of the louver motor assembly according to embodiments of the present invention.
Figure 5B:
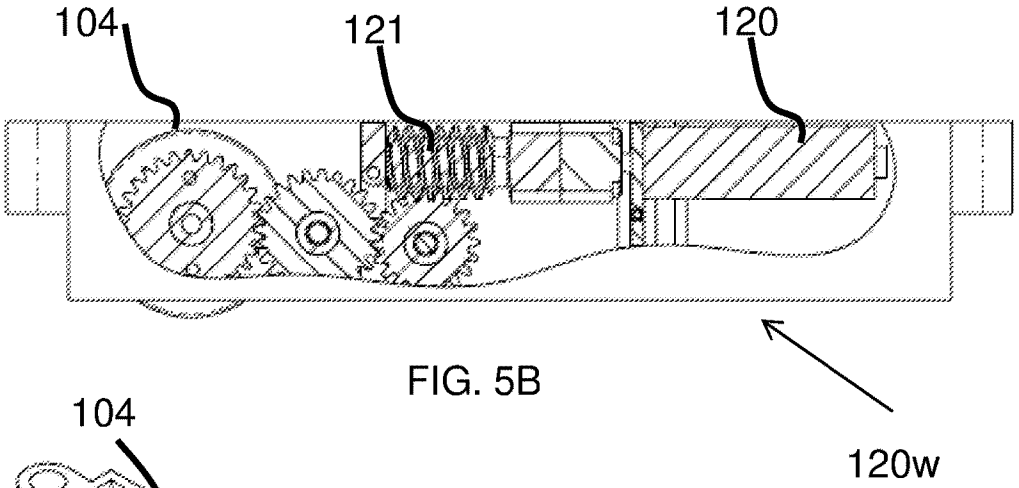
FIG. 5A-B are a schematic illustrative diagrams of an embodiment of a motorized wheel assembly according to embodiments of the present invention.
Figure 5A:
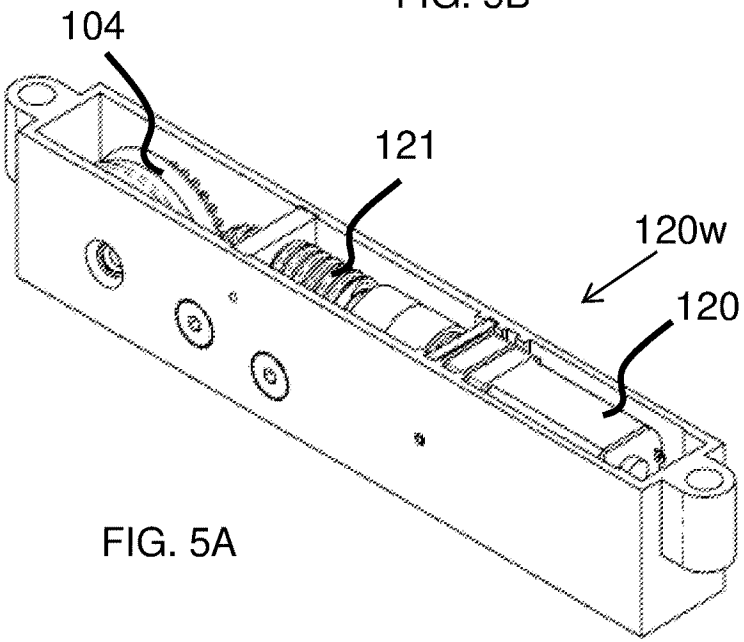

A schematic illustration of optional motors 120 that may be utilized within volume 103 of panel 102 are shown in FIG. 5-6. A lateral sliding motor assembly 120*w* is depicted in FIGS. 5A and 5B that may be utilized to provide panel 102 with motion in the lateral direction along rail 55 as depicted by arrows 102*a*. A louver motor assembly 120*r* is depicted in FIG. 6, and provides for controlling the angulation assumed by blinds 112 within a louver blind 110, or may alternatively be used to open/close a dry-keep window.

Mobile panel 102 features at least one or more remotely controllable motorized wheel 104 associated with a motor 120 that is remotely controlled, for example by remote controlled 150, through the electronics mounted in the frame 130, with a motor control signal 120*s*. Optionally remotely controllable motorized wheel 104 may be disposed along at least one or more of the upper edge or lower edge of mobile panel 102. Optionally and preferably mobile panel 102 may further feature at least one or more non-motorized wheel 106, along at least one or more of upper edge or lower edge.

Optionally and preferably motor assembly 120*r* (FIG. 6) may be functionally coupled to and/or associated with and controlled by electronics unit 130, for example by way of wiring. Preferably wiring coupling motor assembly 120*r* and electronics unit 130 is internal to mobile panel 102 within its inner volume 103.

Optionally and preferably motor assembly 120*w* (FIG. 5A-B) may be functionally coupled to and/or associated with and controlled by electronics unit 130, most preferably by way of wiring. Preferably wiring coupling motor assembly 120*w* and electronics unit 130 is internal to mobile panel 102 within its inner volume 103.

Figure 2A:
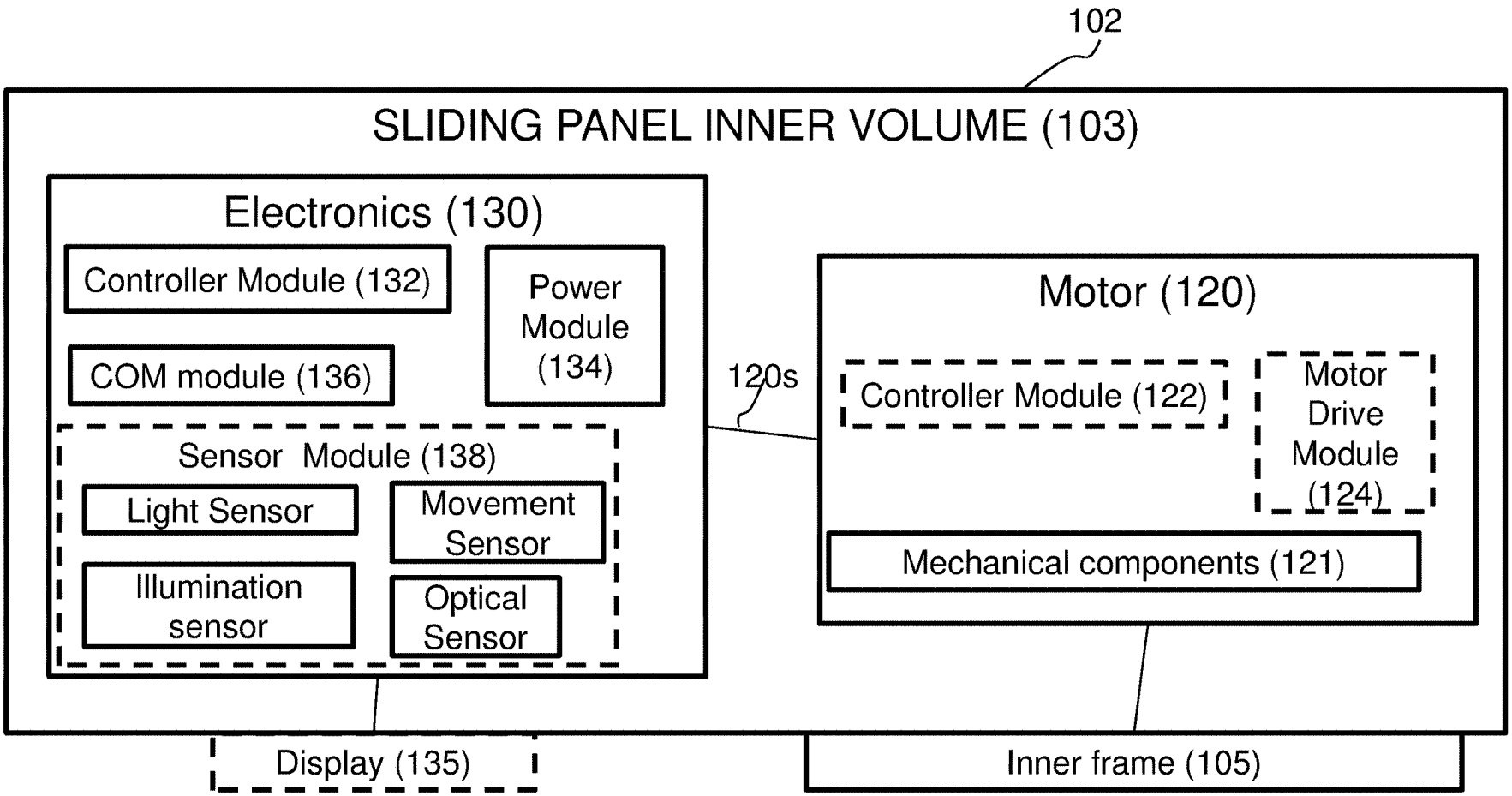
FIG. 2A-B are schematic block diagrams of embodiments of exemplary system components according to the present invention.

Optionally and preferably motor 120 may be functionally coupled with an electronics unit 130 that comprises a controller module 132, power module 134, communication module 136, for example as shown in greater detail in FIG. 2A. In embodiments, electronics unit 130 may optionally further comprise a sensor module 138 comprising at least one or more sensors for example including but not limited to proximity sensor, ultrasound proximity sensor, magnetic sensor, ultrasound sensor, microphone, accelerometer, light sensor, illumination sensor, light level sensor, the like or any combination thereof.

In embodiments, electronics unit 130 may further feature a display 135 that may for example be provided in the form of a LED indicator, LCD display, LED display, LED array, alphanumeric display, or the like as is known in the art. Optionally, for power management purposes control of the display 135 may be functional only when instructed so by the remote controller 150 and/or controller 132.

Optionally communication modules 136 may be configured for wireless communication utilizing wireless communication protocol for example including but not limited to infrared (IR), radiofrequency (RF), BLUETOOTH™, Low Energy Bluetooth™ (BLE), Wi-Fi™, ZigBee™, ANT™, cellular communication, optical communication, acoustic communication, the like, or any combination thereof.

Optionally mobile panel 102 may be provided with a removable cover to allow access to inner volume 103 therein providing an access point for example to access electronics unit 130. In particular such cover may be configured to provide access to power module 134 so as to allow for easy and quick replacement of power source 134 for external recharging and/or replacement when provided in the form of batteries and/or rechargeable power source.

Optionally system 100 may be provided with a charging connector and/or socket, for example in the form of a USB port or the like power supply port, so that rechargeable batteries may be periodically connected to an external, removable charger and/or mains power supply.

Preferably at least one or more motor 120 may be utilized to operate functions associated with functional segment 105. For example, motor 120 that is associated with functional segment 105 provided in the form of a window may provide for remotely opening and/or closing a dry keep window fit over functional segment 105. For example, motor 120 that is associated with segment 105 may be provided in the form of a framed louver 110, may be utilized to control the angular position of blinds 112 associated with a louver 110, as will be discussed in greater detail below, Preferably motor 120 may be used to mobilize mobile panel 102 for example by mobilizing and/or operating wheel 104.

In embodiments, mobile panel 102 may be further fit with a photovoltaic cell 140 for example in the form of a solar panel, or the like. Optionally the photovoltaic cell 140 may be utilized to directly power any portion of electronics unit 130 or motor 120, and/or to charge rechargeable power source associated with mobile frame 103, and in particular power module 134.

Optionally motor power supply module 124 may be provided in the form of a battery, rechargeable power source or the like. More preferably power supply module 124 is provided in the form of a battery or rechargeable power source internal to panel 102 within internal volume 103, configured so that panel 102 may be fully mobile without external wiring or cables that could limit or complicate the movement of panel 102 within fixed frame 50.

Optionally power supply module 124 provided in the form of a rechargeable power source may be recharged periodically by mains power supply as is needed and/or indicated to a user. Optionally power supply module 124 may be readily recharged and/or replaced by a user so as to allow recharging external to panel 102 and/or allow easy replacement of the power source utilized.

Figure 2B:
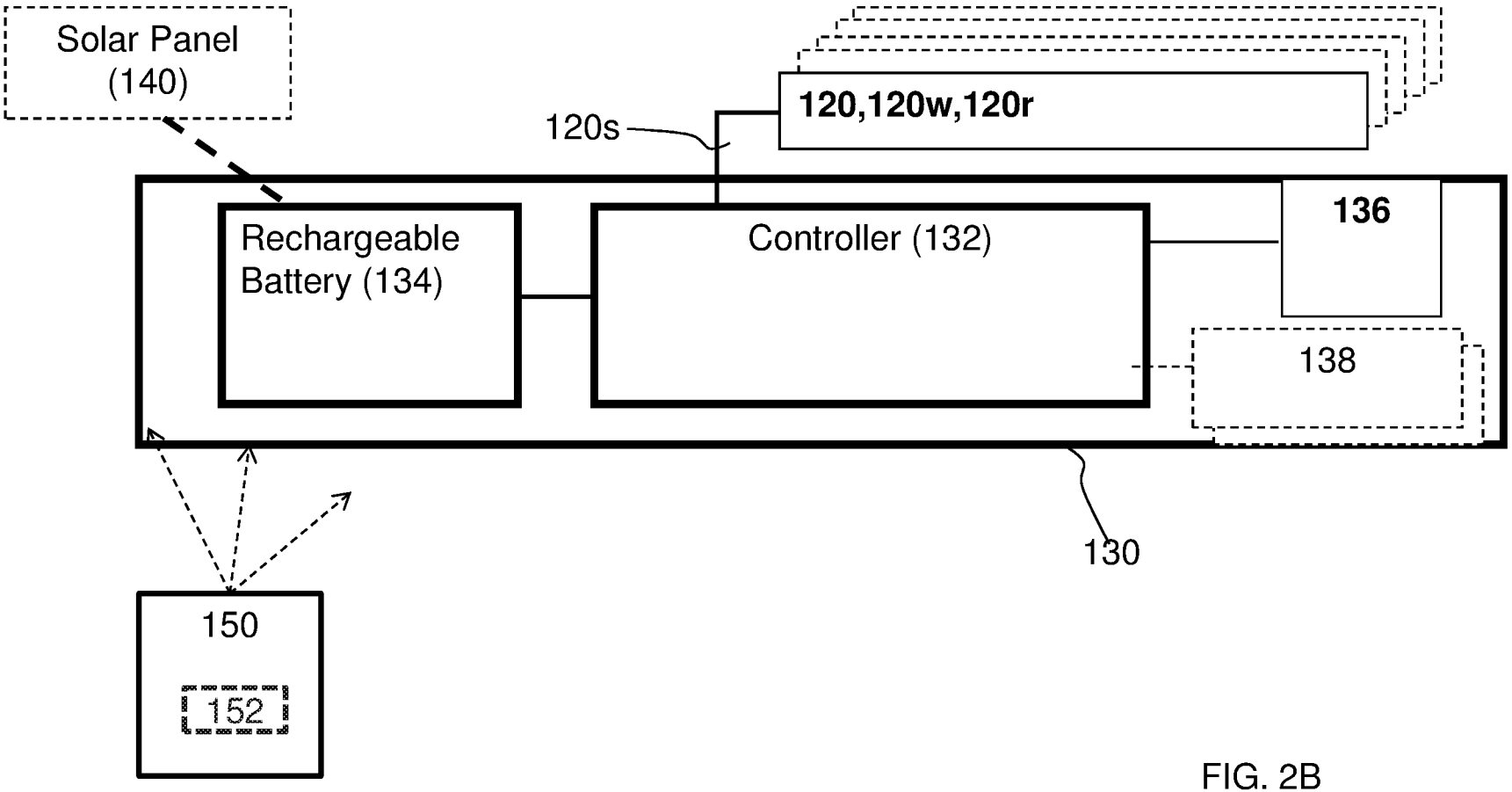

FIG. 2B shows a schematic block diagram of how a plurality of motors 120, 120*r*, 120*w* may be controlled with a single electronics unit 130, utilizing at least one or more motor control signal 120*s*. Most preferably electronics unit 130 maintains the mobility of system 100 along rail 55 by utilizing a mobile power source for example in the form of rechargeable power source and/or batteries as part of power module 134. Optionally power module 134 may be powered from photovoltaic cells 140. As previously described system 100 may feature at least one or more sensors within sensor module 138 and remote controller 150 to facilitate functionally and mobility of panel 102.

A proximity sensor may be utilized with a sensor module 138 for facilitating movement of plurality of panels 102 relative to one another. In an optional embodiment sensor module may for example include but is not limited to sensors provided in the form of a light sensor and/or an illumination sensor, electromagnetic sensor, magnetic sensor, microphone, acoustic sensor, motion sensor, the like or any combination thereof.

Communication module 136 may be utilized to receive control signals from remote controller 150. Communication module 136 in turn communicate through the controller module 132 with motors 120 to control the panel movement 102 and/or any inner functional segment 105 associated therewith, for example in the form of a window or a louver blinds 110.

Figure 4A:
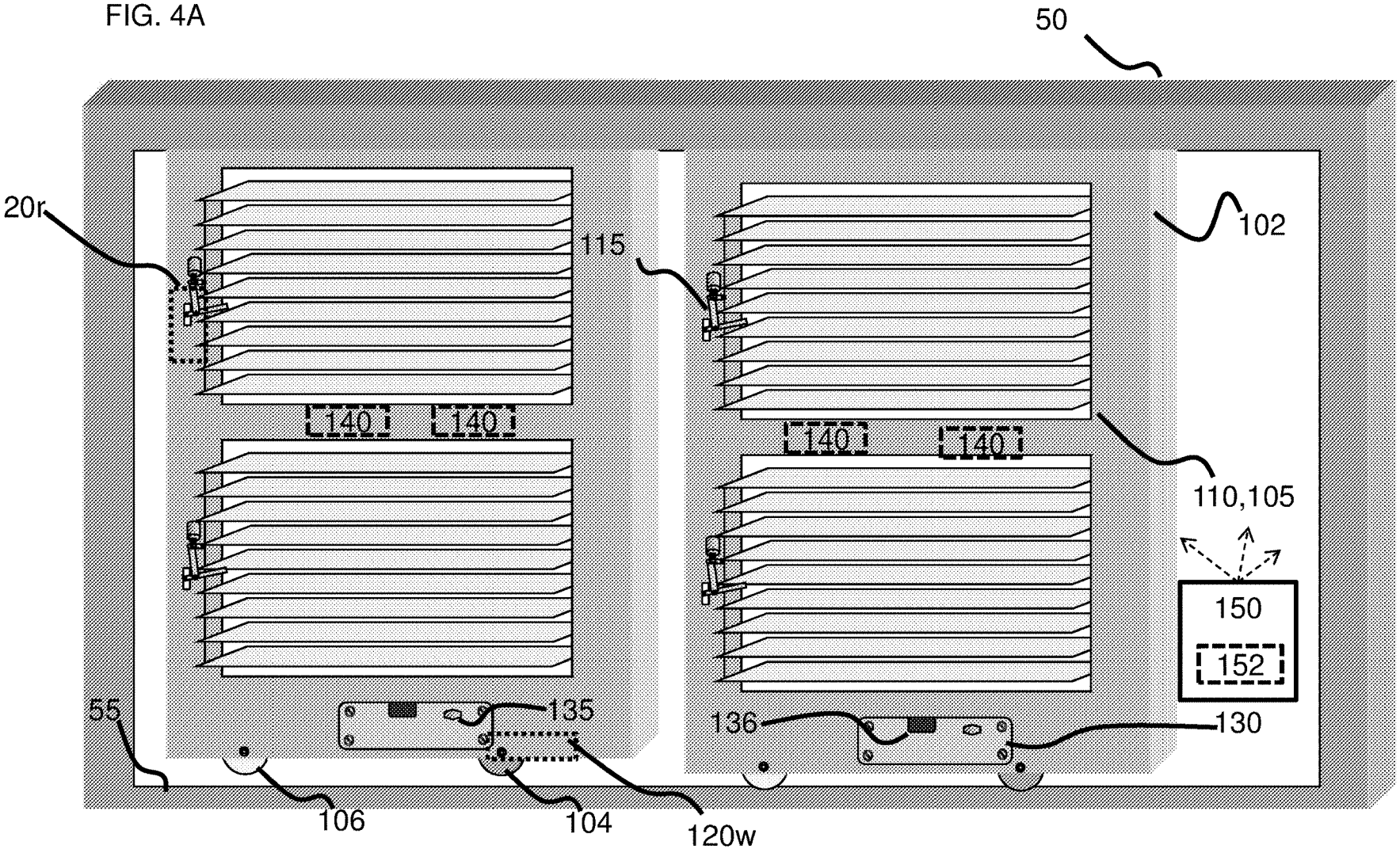
FIG. 4A-C are schematic illustrative diagrams of embodiments of a system according to optional embodiments of the present invention.
Figure 4B:
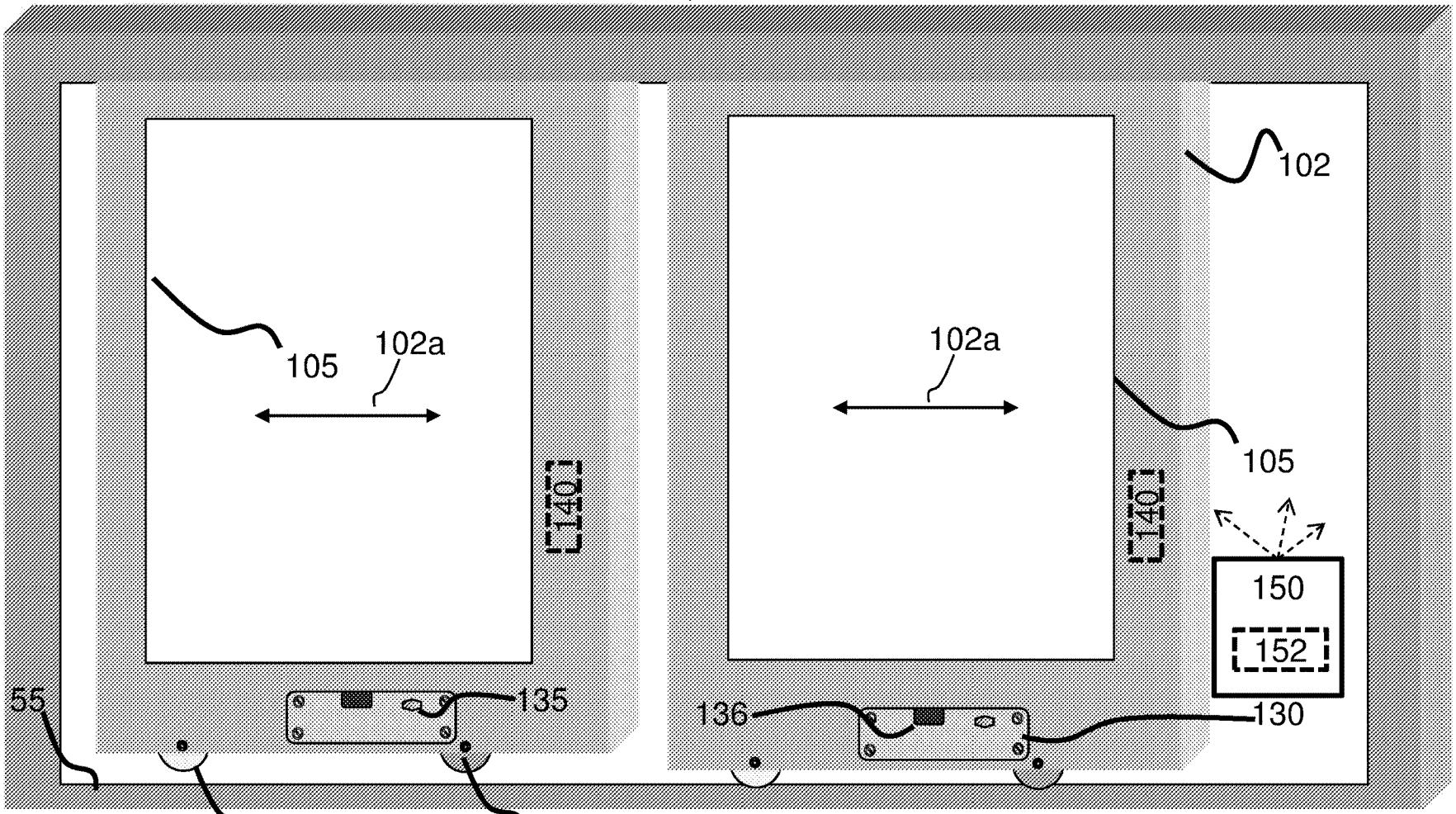
Figure 4C:
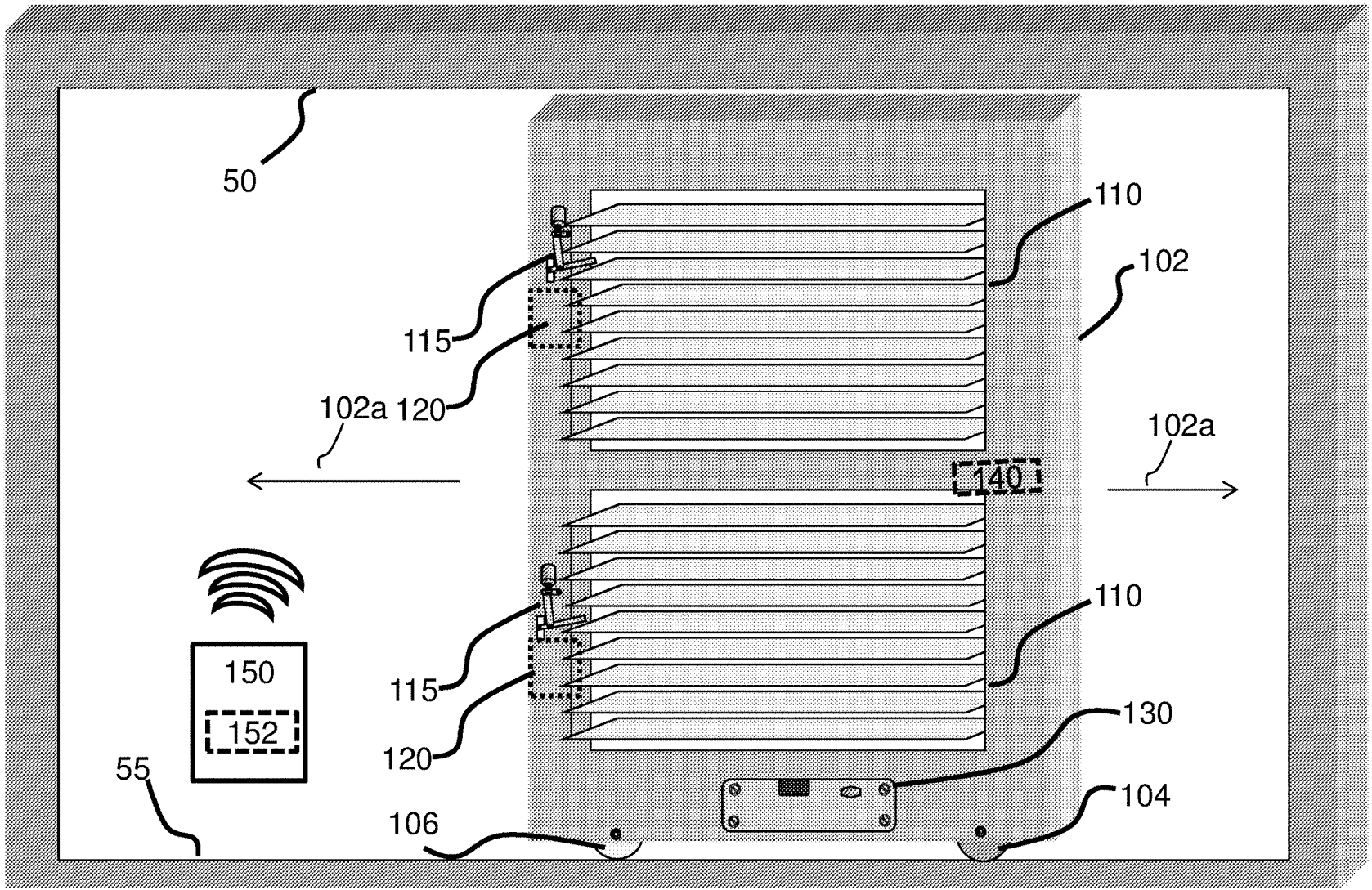

Now referring to FIG. 3-4 that show embodiments of the present invention in utilizing system 100 with different forms of a mobile panel and plurality of panels that are similar to mobile panel 102 as previously described. FIG. 3A shows an embodiment wherein panel 102 provided in the form of a blind louver 110 featuring blinds 112 is installed on an inner surface of frame 50 about rail 55. FIG. 3B shows an embodiment wherein panel 102 is disposed along a rail 55 that is featured along an outer face of a construction 50. FIG. 4A shows an embodiment of system 100 having a plurality of mobile panels featuring a plurality of louver blinds 110. FIG. 4B shows an embodiment of system 100 that is fit with a plurality of mobile panels 102 wherein e each panel is fit with an inner functional segment 105 for example shown in the form of a window. FIG. 4C shows an embodiment of system 100 featuring single mobile panel 102 that is fit a plurality of individual inner functional segments 105 each in the form of a framed louver blind 110.

An open living space area construct 10 featuring a fixed framed construct 50 that features a rail 55 that allows the mobile panel 102 to be moved latterly 102*a* along the opening of fixed frame 50. As previously described panel 102 may be utilized to house a plurality of optional inner functional segments 105.

Fixed frame 50 and/or rail 55 may be placed over different living space opening within a house and/or apartment to provide a living space partition such as a window, balcony, patio, solarium, or the like living area. An optional embodiment, for example as shown in FIG. 3B, provides a rail 55 that is disposed along an external (outdoor) face of an optional construct fixture 50.

FIG. 3A shows an embodiment of system 100 that is characterized in that at least one or more louver 110 may be fully controlled to control shading/lighting and airflow within a living space 10 and mobilized remotely with remote controller 150 to move the mobile panel 102 inside its fixed frame 50 framework. Implementing system 100 as shown in FIG. 3A most preferably may be accomplished without requiring constructional changes to the living space construction framework 10, in particular when retrofitting the living space 10 to system 100. When installing or retrofitting system 100 in living space 10 no additional elements such as wiring, mechanical adaptors or the like are mounted and/or affixed onto fixed frame 50. That is louver 110 disposed inside movable panel 102 does not require fixed coupling to wall structures 10 and/or fixed frame 50 and is therefore fully mobile within the an existing framework 50 Accordingly system 100 is adept for retrofitting existing fixed frame 50 in order to make fixtures associated therewith fully automated, without requiring structural changes.

FIG. 3A shows a louver 110 that may be configured to fit over a small living space fixed frame 50, for example utilized to fit over a window opening. Optionally in such a window frame application at least a portion of rail 55 may be fit within a pocket of the window frame. However, the present invention is not limited to such single louver frame 110, wherein louver system 100 may comprise a plurality of such louver frame 110 that may be combined over external plurality of movable panels 102 for uses in a large opening fixed frame 50, for example as shown in FIG. 4A-B. The present invention would be more appreciated for large openings with plurality of large frames where manual operation is cumbersome and access to the frames is not simple due to obstacles such as furniture that are placed adjacent to the opening, or behind a closed window.

Embodiments of the present invention provide system 100 for an automated framed louver 110 inside a movable panel 102 and for such system wherein a non-automated framed louver in place within an existing fixed frame 50 is replaced with a new panel 102 according to embodiments of the present invention, such that system 100 is retrofit and incorporated with the framework of an existing non-automated louver.

System 100 provides an automated framed louver 110 that may be remotely controlled with a wireless control signal 150*s* from a remote controller 150. Remote controller 150 may be provided in the form of remote controller, hand held mobile device, hand held mobile communication device, smartphone, or the like device having communication and processing capabilities, for example as is known in the art.

Remote controller 150 optionally may further comprise a video camera 152. Video camera 152 may be utilized with to facilitate control of any portion of system 100 so as to provide images for analysis and control of the position of at least one of the panel 102, blinds 112, louver blind 110, or any combination thereof, wherein control is provided by way of utilizing state of the art image processing protocols or video processing protocols.

System 100 may feature a mobile pane 102 provided in the form of a louver 110 that comprises a plurality of blinds and/or shutters 112 that may assume an open angle of up to 180 degrees, such that it is fully closed at 180 degrees and fully open at 90 degrees. As is known in the art, blinds 112 are collectively controlled to assume an angle of up to 180 degrees with a louver lever 115 that provides for tilting and changing the angle of at least a group of said plurality of blinds 112. Lever 115 is mechanically coupled with at least a group of said plurality of blinds 112 so as to simultaneously control their angle. Preferably each group of blinds may be associated with a single lever 115 that is controlled with a motor 120.

System 100 comprises a motor assembly 120 that is functionally coupled with louver lever 115, wherein the motor assembly 120 is provided for controlling the position of lever 115 and therein controlling the angle assumed by blinds 112. Most preferably motor assembly 120 is fit within a recess of frame 103, such that it preferably it is minimally visible. Motor assembly 120 features the required mechanical components 121, for example in the form of a gear box, shaft, cam or the like, that are coupled with lever 115 to provide for controlling the position of lever 115 and therein the angle assumed by blinds 112. Motor assembly 120 is functionally coupled to and/or associated with and controlled by electronics unit 130, for example by way of wiring, as previously described.

Optionally louver 110 may be further fit with a photovoltaic cell 140 for example in the form of a solar panel, or the like.

Optionally and preferably mobile panel 102 provided in the form of louver 110 may be fit with at least one or more motorized wheels 104 associated with a motor 120, 120*w* that may be controlled with a motor control signal 120*s*, as previously described.

Optionally louver 110 may be further fit with a mechanical non-automated wheel 106. Preferably wheel 106 provides for balancing louver 110 within a living space opening 50, as previously described.

Optionally blinds 112 may be vertical and/or horizontal blinds, more preferably blinds 112 are horizontal blinds, for example as shown and as practical in Mediterranean weather.

Embodiments of the present invention provide for retrofitting components of system 100 within an existing louver fit within a living space without making constructional changes to the living space construct 10 of fixed frame 50 within it. Most preferably retrofitting occurs by replacing the sliding panel 102 with new ones that include the system 100 components.

FIG. 4A shows as schematic illustrative depiction system 100 within an existing louver system frame 50 wherein a plurality of louver mobile panel 102 each having a plurality of individual functional segments 105 in the form of louver 110 that are retrofit within an existing fixed frame 50.

Mobile panel 102 is fit with a plurality of motors 120 to control individual inner functional segment 105 that feature framed louver 110 that are controlled with louver levers 115 as well as motorized wheel 104. Preferably both mobile panel 102 and each framed louver are controlled and/or automated with at least one or more electronics unit 130 provided to control a group of motors 120. As previously described most preferably motors 120 are disposed within an internal volume 103 of panel 102.

As shown in FIG. 4A an existing louver system fit within a fixed frame 50 and comprising at least two panels 102 that are fit over a railing 55. Panels 102 each comprise at least two louvers 110 for controlling the angle of a plurality of blinds 112 with individual louver lever 115. Each mobile panel 102 includes an electronics unit 130 and three motors 120 to individually control each of the louver levers 115 provided within each panel 102 as well as a motorized wheel 104 coupled to a motor 120 so as to allow control of the motion of panel 102 in the lateral direction 102*a* along rail 55.

All motors 120 may be remotely controlled with remote controller 150 via a control signal communicated to the appropriate components of electronics unit 130 and to motor units 120.

Optionally a proximity sensor may be attached to the edge of a mobile panel 102 and may be utilized to detect the border of the fixed frame 50 opening and/or an adjacent mobile panel 102 so that, if desired, the controller 132 may automatically control the movement of the at least one or more wheels 104 disposed about mobile panel 102.

As previously described, at least one or more wheels 104 may be disposed along any portion of panel 102 and more preferably along a lower or upper edge of panel 102.

As shown no constructional changes are required to the existing frame opening 50 in order to convert an existing non-automated louver system to an automated louver system 100 according to embodiments of the present invention.

Optionally the rechargeable batteries may be re-charged by proximity electromagnetic field chargers ("wireless charger").

Optionally system 100 may be configured to utilize mains power supply (not shown) to periodically re-charge electronic unit 130 and/or power modules 134. Optionally the charging may be by way of a socket on fixed frame 50 where panel 102 may park in certain position for charging having charging contacts that have corresponding contacts disposed along at least one of panels 102 surface or rail 55. These are less preferred in comparison to the above mentioned non wired ways of charging, such as with photovoltaic cells 140 mounted on the panel 102, since it requires bringing power supply to the frame which may not be simple in retrofit situation. However, such solution is fine when the system is not a retrofit and even in retrofit situation it is by far less complex than providing fixed power lines to movable frames.

FIG. 4B shows an optional system that features a mobile panel 102 featuring a functional segment 105 shown in the form of a window. Optionally functional segment 105 may be provided in the form of a dry keep window wherein motors 120 disposed within inner volume 103 of mobile panel 102 may be utilized to control the open status of window disposed about functional segment 105. Optionally in such embodiments the status of segment 105 may be controlled with a control signal from remote controller 150 via controller 132 of electronics units 130.

FIG. 4C shows a schematic illustration similar to that depicted in FIG. 4A however using a single mobile panel 102 disposed about fixed frame 50 wherein the single panel 102 comprises a plurality of functional segment 105 shown in the form of louver 110.

FIG. 5A shows a perspective view of a schematic illustration of an embodiment of the motorized wheel assembly 120*w* that includes the wheel 104 and motor 120 and mechanical elements 121 in the form shaft and gear elements all disposed within a housing that fits to the inner volume 103 preferably along a lower edge of panel 102, as previously described. FIG. 5B shows a cut away view of motor assembly 120*w* to further show functional parts.

FIG. 6 is a schematic depiction of one embodiment of a louver motor assembly 120 that includes mechanical members 121 for example including but not limited to motor, gear and shaft and controlling and driving electronics 122, that may be used to control the degree of opening of blinds 112 associated therewith. Preferably motor 120 is disposed within an internal volume 103 of panel 102, as previously described.

While the invention has been described with respect to a limited number of embodiment, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not described to limit the invention to the exact construction and operation shown and described and accordingly, all suitable modifications and equivalents may be resorted to, falling within the scope of the invention.

Citation or identification of any reference in this application shall not be construed as an admission that such reference is available as prior art to the invention.

Section headings are used herein to ease understanding of the specification and should not be construed as necessarily limiting.

While the invention has been described with respect to a limited number of embodiments, it will be appreciated that many variations, modifications and other applications of the invention may be made.

What is claimed is:

1. A system (100) for controlling at least one mobile panel (102) within a living space (10) having at least one rail (55), wherein said at least one mobile panel (102) is moveable along said at least one rail (55), wherein said mobile panel (102) comprises a lower edge, an upper edge, a right edge, a left edge, wherein said edges from a portion of a framework surrounding said mobile panel (102) featuring an internal open volume (103), the panel (102) featuring a functional surface along said mobile panel between the edges of the panel framework, and wherein the functional surface features at least one functional segment (105), the system including:

a. at least one motor assembly (120) and an electronics unit (130) that are functionally coupled with one another, and wherein said at least one motor assembly (120) and said electronics unit (130) are housed internal to said panel (102) within said internal volume (103); wherein said electronics unit (130) controls said at least one motor (120) with at least one or more control signal (120*s*); and wherein said at least one motor (120) is associated with at least one motorized wheel (104); said at least one motorized wheel (104) is configured to travel along said at least one rail;

b. said electronics unit (130) features a controller module (132), a power module (134) and communication module (136);

c. a remote controller (150), provided external to said at least one panel (102), and in wireless communication with said electronics unit (130); wherein said remote controller (150) controls said at least one motor (120) via said electronics unit (130).

2. The system of claim 1 wherein said at least one functional segment (105) is provided in a form selected from at least one or more of the following: louver blinds (110, 112), window, dry keep window, rollup blinds, motorized rollup blinds, blinds (112) or a combination thereof.

3. The system of claim 2 wherein said at least one functional segment (105) is controlled with said at least one or more motors (120).

4. The system of claim 1 wherein at least one functional segment (105) is a louver blind (110), said louver blind (110) including:

a. an arrangement of a plurality of blinds (112) that are uniformly controlled with at least one louver lever (115); said louver lever (115) is functionally associated with said plurality of blinds (112) so as to control an angular position of said plurality of blinds (112); wherein said blinds are configured to assume an angle of up to 180 degrees, wherein the angle is determined based on a position of said louver lever (115);

b. said louver lever (115) is functionally associated with said at least one motor (120) that is controlled with a wired control signal (120*s*); wherein said motor is configured to adjust a position and an angle of said louver lever (115) therein controlling said angular position of said plurality of blinds (112).

5. The system of claim 1 wherein said mobile panel (102) is further fit with at least one passive non-motorized wheel (106) and wherein said passive wheel balances said mobile panel (102) along said rail (55).

6. The system of claim 1 wherein each of said mobile panel (102) and said at least one motor (120) disposed therein are each provided with a unique address or identifier.

7. The system of claim 1 further comprising a camera (15, 152) providing a view of the living space (10) wherein movement of panel (102) or louvers (115) are controllable utilizing image processing protocols based on an image rendered with said camera (15, 152).

8. The system of claim 1 wherein said power module (134) is configured to utilize a power source selected from at least one or more of: a rechargeable power source, a battery, photovoltaic cells (140), a rechargeable power source recharged via photovoltaic cells, or any combination thereof.

9. The system of claim 8 wherein the rechargeable power source or battery is removable from said mobile panel.

10. The system of claim 1 wherein said power module (134) is configured to be charged through a dedicated recharging socket.

11. The system of claim 10 wherein said dedicated recharging socket is a USB connector or a power connector.

12. The system of claim 10 wherein said power module is a rechargeable power supply that is configured to be recharged by connecting to a mains power supply via said recharging socket or through proximity wireless charger.

13. The system of claim 12 wherein the proximity wireless charger comprises:

a. a first portion having at least one or more recharging positions provided along at least a portion of at least one structure selected from a fixed construct surrounding said panel or said rail therein forming at least one or more recharging positions, wherein the recharging position is connected to a power source and features proximity charging contacts; and b. a second portion including a corresponding proximity charging contacts disposed on the power module (134), wherein the corresponding proximity charging contracts are configured to be charged from said proximity changing contacts disposed on said fixed construct surrounding said panel or said rail.

14. The system of claim 1 wherein said electronics unit (130) further comprises a sensor module (138) comprising at least one or more sensor selected from: an electromagnetic sensor, a magnetic sensor, a mechanical sensor, a IR sensor, an optical sensor, a light sensor, a movement sensor, a illumination sensor, a light level sensor, an acoustic sensor, an ultrasound sensor, a microphone, a proximity sensor or any combination thereof.

15. The system of claim 14 wherein said sensor module (138) comprises at least one or more proximity sensors disposed along an outer edge of said mobile panel (102).

16. The system of claim 4 wherein said panel (102) is configured to have at least two or more louver levers (115) wherein each lever is configured to control an individual group of said plurality of blinds (112) and wherein each lever is associated with its own motor (120).

17. The system of claim 4 wherein said louver lever is disposed within a recess formed along the panel's framework.

18. The system of claim 1 wherein said electronics unit (130) is functionally associated with said motor (120) with wiring disposed within said inner volume (103).

19. The system of claim 1 wherein said electronics unit (130) further comprise a display, the display selected from: Light Emitting Diode (LED) indicator, Liquid Crystal Display (LCD), alphanumeric display, LED display, LED array, or a combination thereof.

20. A smart home system comprising the system of claim 1 and a master controller wherein said master controller is further provided for communicating and controlling said electronics unit (130).

* * * * *